US011536049B2

(12) United States Patent
Zhou et al.

(10) Patent No.: US 11,536,049 B2
(45) Date of Patent: Dec. 27, 2022

(54) LOCK STATE MONITORING APPARATUS, METHOD, LOCK DRIVING APPARATUS AND LOCK ASSEMBLY

(71) Applicant: SHENZHEN GOODIX TECHNOLOGY CO., LTD., Shenzhen (CN)

(72) Inventors: Wei Zhou, Shenzhen (CN); Ming Zhu, Shenzhen (CN); Mingliang Wang, Shenzhen (CN)

(73) Assignee: SHENZHEN GOODIX TECHNOLOGY CO., LTD., Shenzhen (CN)

( * ) Notice: Subject to any disclaimer, the term of this patent is extended or adjusted under 35 U.S.C. 154(b) by 389 days.

(21) Appl. No.: 16/833,692

(22) Filed: Mar. 30, 2020

(65) Prior Publication Data

US 2020/0284065 A1 Sep. 10, 2020

Related U.S. Application Data

(63) Continuation of application No. PCT/CN2019/077214, filed on Mar. 6, 2019.

(51) Int. Cl.
*E05B 47/00* (2006.01)

(52) U.S. Cl.
CPC .. *E05B 47/0012* (2013.01); *E05B 2047/0069* (2013.01); *E05B 2047/0097* (2013.01); *E05Y 2400/33* (2013.01)

(58) Field of Classification Search
None
See application file for complete search history.

(56) References Cited

U.S. PATENT DOCUMENTS

2013/0137286 A1 5/2013 Smith
2014/0033773 A1* 2/2014 Myers ..... E05B 63/08 292/144

(Continued)

FOREIGN PATENT DOCUMENTS

CN 103732843 A 4/2014
CN 203640431 U 6/2014

(Continued)

OTHER PUBLICATIONS

The EESR of parallel EPO application No. 19861286.3.

(Continued)

*Primary Examiner* — Thomas S McCormack
(74) *Attorney, Agent, or Firm* — J.C. Patents

(57) ABSTRACT

A lock state monitoring apparatus, a method, a lock driving apparatus and a lock assembly. The lock state monitoring apparatus includes: a rheostat and a first load, where a movable contact end of the rheostat is connected with a first end of the first load, and a first fixed end of the rheostat and a second end of the first load are configured to bear a first voltage; the movable contact end of the rheostat is configured to be connected with an output axis of a drive motor in the lock; the first fixed end and the movable contact end of the rheostat, or two ends of the first load, are configured to be connected with a main control board in the lock to output a first voltage signal to the main control board, so that the main control board determines a lock state according to the first voltage signal.

17 Claims, 5 Drawing Sheets

(56) References Cited

U.S. PATENT DOCUMENTS

| | | | | |
|---|---|---|---|---|
| 2014/0266584 | A1 | 9/2014 | Ingle | |
| 2016/0319571 | A1 | 11/2016 | Johnson | |
| 2017/0002586 | A1 | 1/2017 | Lee | |
| 2019/0226827 | A1 * | 7/2019 | Caterino | E05B 47/026 |

FOREIGN PATENT DOCUMENTS

| | | | |
|---|---|---|---|
| CN | 106320825 | A | 1/2017 |
| CN | 107015106 | A | 8/2017 |
| CN | 107165497 | A | 9/2017 |
| CN | 107386813 | A | 11/2017 |
| CN | 107528375 | A | 12/2017 |
| CN | 101105087 | A | 1/2018 |
| CN | 108305369 | A | 7/2018 |
| CN | 208137685 | U | 11/2018 |
| CN | 208335237 | U | 1/2019 |
| JP | H06-225368 | A | 8/1994 |

OTHER PUBLICATIONS

First Office Action of the priority application.
The Chinese International Search Report of corresponding International application No. PCT/CN2019/077214, dated Nov. 21, 2019.

* cited by examiner

LOCK STATE MONITORING APPARATUS, METHOD, LOCK DRIVING APPARATUS AND LOCK ASSEMBLY

CROSS-REFERENCE TO RELATED APPLICATIONS

This application is a continuation of International Application No. PCT/CN2019/077214, filed on Mar. 6, 2019, the disclosure of which is hereby incorporated by reference in its entirety.

TECHNICAL FIELD

The present application relates to the field of smart home and, in particular, relates to a lock state monitoring apparatus, a method, a lock driving apparatus and a lock assembly.

BACKGROUND

Intelligent locks are composite locks that are improved on the basis of traditional mechanical locks and have higher safety, convenience and advancement. For the working principle of the intelligent locks, a motor is used mostly to drive the movement of a lock cylinder to realize the functions of unlocking and locking.

A main control board in an intelligent lock needs to acquire the current state of the lock through an induction apparatus, that is, to determine whether the lock is currently in an unlocked state or in a locked state, before controlling a motor to realize unlocking and locking. In the prior art, an intelligent lock usually includes four parts: a main control board, a motor, an induction apparatus and a lock cylinder, and currently, the integration schemes for the main control board, the motor and the lock cylinder are relatively mature and unified.

However, for the above induction apparatus for acquiring the state of the lock, a unified standard still has not been formed in the industry, which leads to a problem that induction apparatuses of different structures are needed to match intelligent locks of different types, thereby greatly increasing development and production costs of the intelligent locks.

SUMMARY

The present disclosure provides a lock state monitoring apparatus, a method, a lock driving apparatus and a lock assembly, so as to adapt to state monitoring of locks of different types to reduce development and production costs of the locks.

In a first aspect, an embodiment of the present disclosure provides a lock state monitoring apparatus, where the apparatus is applied to a lock, and the apparatus includes: a rheostat and a first load;

a movable contact end of the rheostat is connected with a first end of the first load, and a first fixed end of the rheostat and a second end of the first load are configured to bear a first voltage;

the movable contact end of the rheostat is configured to be connected with an output axis of a drive motor in the lock, so that the drive motor drives the movable contact end to move to change a resistance value between the first fixed end and the movable contact end;

the first fixed end and the movable contact end of the rheostat, or two ends of the first load, are configured to be connected with a main control board in the lock to output a first voltage signal to the main control board, so that the main control board determines a lock state according to the first voltage signal, where the lock state includes: an unlocked state and a locked state.

In a possible design, the rheostat is a rotary potentiometer, and the movable contact end is a rotating end of the rotary potentiometer;

the rotating end is configured to be connected with the output axis of the drive motor, so that the rotating end rotates with the output axis of the drive motor to change a resistance value of the rotary potentiometer that is connected in a circuit.

In a possible design, the first load is a first resistor.

In a possible design, the lock state monitoring apparatus further includes: a second load;

a first end of the second load is configured to be connected with a first input of the drive motor, so that a driving output current drives the drive motor after flowing through the second load;

two ends of the second load are configured to be connected to the main control board to output a second voltage signal to the main control board, so that the main control board determines, according to the second voltage signal, whether the lock reaches a clamping position.

In a possible design, the second load is a second resistance.

In a second aspect, an embodiment of the present disclosure provides a lock driving apparatus, including: a drive motor, and the lock state monitoring apparatus according to any one of the first aspect.

In a third aspect, an embodiment of the present disclosure provides a lock assembly, including: a main control board, a drive motor, a lock cylinder, and the lock state monitoring apparatus according to any one of the first aspect;

the main control board is connected with the drive motor to control the drive motor to rotate;

the output axis of the drive motor is connected with the lock cylinder, so that the lock cylinder moves between a first position and a second position under action of the drive motor; when the lock cylinder is located at the first position, the lock state is the unlocked state, and when the lock cylinder is located at the second position, the lock state is the locked state.

In a fourth aspect, an embodiment of the present disclosure provides a lock state monitoring method, where the method is applied to the lock assembly of any one of the third aspect, and the method includes:

acquiring the first voltage signal between the first fixed end and the movable contact end of the rheostat, or between the two ends of the first load; and determining the lock state according to the first voltage signal.

In a possible design, the determining the lock state according to the first voltage signal includes:

converting the first voltage signal into a first digital signal; and determining the lock state according to the first digital signal, where the main control board acquires the first digital signal through a first port.

In a possible design, the determining the lock state according to the first digital signal includes:

in a case that the first voltage signal is a first value as the lock cylinder is located at the first position, determining the lock state to be the unlocked state when the first digital signal is a high level;

in a case that the first voltage signal is a second value as the lock cylinder is located at the second position, determining the lock state to be the locked state when the first digital signal is a low level;

or, in a case that the first voltage signal is a first value as the lock cylinder is located at the first position, determining the lock state to be the unlocked state when the first digital signal is a low level;

in a case that the first voltage signal is a second value as the lock cylinder is located at the second position, determining the lock state to be the locked state when the first digital signal is a high level.

In a possible design, the lock state monitoring method further includes:

acquiring a second voltage signal between two ends of a second load, where a first end of the second load is configured to be connected with a first input of the drive motor, so that a driving output current drives the drive motor after flowing through the second load; and determining a clamping position state of the lock assembly according to the second voltage signal, where the clamping position state includes: a clamping position reaching state and a clamping position non-reaching state.

In a possible design, the determining a clamping position state of the lock assembly according to the second voltage signal includes:

converting the second voltage signal into a second digital signal; and determining the clamping position state according to the second digital signal, where the main control board acquires the second digital signal through a second port.

In a possible design, the determining the clamping position state according to the second digital signal includes:

if the clamping position state is determined by acquiring a multiple between a voltage value corresponding to the second voltage signal and a preset voltage value; then determining the clamping position state to be the clamping position reaching state, when the second digital signal is a high level as the multiple is greater than a preset multiple;

determining the clamping position state to be the clamping position non-reaching state, when the second digital signal is a low level as the multiple is less than or equal to the preset multiple;

or, determining the clamping position state to be the clamping position reaching state, when the second digital signal is a low level as the multiple is greater than a preset multiple;

determining the clamping position state to be the clamping position non-reaching state, when the second digital signal is a high level as the multiple is less than or equal to the preset multiple;

if the clamping position state is determined by acquiring a difference value between the voltage value corresponding to the second voltage signal and the preset voltage value; then determining the clamping position state to be the clamping position reaching state, when the second digital signal is a high level as the difference value is greater than a preset difference value;

determining the clamping position state to be the clamping position non-reaching state, when the second digital signal is a low level as the difference value is less than or equal to the preset difference value;

or, determining the clamping position state to be the clamping position reaching state, when the second digital signal is a low level as the difference value is greater than a preset difference value;

determining the clamping position state to be the clamping position non-reaching state, when the second digital signal is a high level as the difference value is less than or equal to the preset difference value.

In a possible design, the determining the clamping position state according to the second digital signal includes:

acquiring the multiple or difference value between the voltage value corresponding to the second voltage signal and the preset voltage value, if the multiple is greater than the preset multiple or the difference value is greater than the preset difference value, determining the lock assembly to reach the clamping position.

In a fifth aspect, an embodiment of the present disclosure provides an electronic device, including:

a memory, configured to store a program; and a processor, configured to execute the program stored in the memory, where when the program is executed, the processor is configured to use the lock state monitoring method according to any one of the fourth aspect to monitor the lock state of the lock assembly.

In a sixth aspect, an embodiment of the present disclosure provides a computer readable storage medium, including: instructions which, when executed on a computer, cause the computer to execute the lock state monitoring method according to any one of the fourth aspect to monitor the lock state of the lock assembly.

In the lock state monitoring apparatus, the method, the lock driving apparatus and the lock assembly provided by the present disclosure, by connecting the portion of the rheostat that is connected in the circuit with the first load in series, then loading the stable first voltage on the portion of the rheostat that is connected in the circuit and the first load, and connecting the movable contact end of the rheostat with the output axis of the drive motor in the lock, so that when the lock performs unlocking/locking operations using the drive motor, the resistance value of the portion of the rheostat that is connected in the circuit is also changed at the same time, thereby the first voltage signal between the first fixed end and the movable contact end of the rheostat or between two ends of the first load is changed; and the first voltage signal is sent to the main control board on the lock, thereby the main control board compares the different values corresponding to the current first voltage signal with the preset value calibrated under each state to realize the determining of the lock state. Through the strong coupling linkage relationship between the rotation of the drive motor and the resistance value of the rheostat, accurate monitoring of the lock state can be realized only by adding simple devices, and adaptation to locks of different types can be realized, thereby greatly reducing development and production costs of the locks.

BRIEF DESCRIPTION OF THE DRAWINGS

In order to more clearly illustrate technical solutions in embodiments of the present disclosure or in the prior art, the drawings used in describing the embodiments or the prior art will be briefly described below. Obviously, the drawings in the following description are some embodiments of the present disclosure, and those skilled in the art could obtain other drawings from these drawings without creative effort.

The explicit embodiments of the present disclosure have been shown by the above drawings, and will be described in more detail later. Theses drawings and text descriptions are not intended to limit the scope of the concept of the present disclosure in any way, but to illustrate the concept of the present disclosure for those skilled in the art by reference to specific embodiments.

DETAILED DESCRIPTION OF THE EMBODIMENTS

In order to make purposes, technical solutions and advantages of embodiments of the present disclosure clearer, technical solutions in the embodiments of the present disclosure will be clearly and comprehensively described in conjunction with the drawings in the embodiments of the present disclosure. Obviously, the described embodiments are part of embodiments of the present disclosure, rather than all of the embodiments. All other embodiments obtained by those skilled in the art based on the embodiments of the present disclosure without creative effort are within the protection scope of the present disclosure.

The terms "first", "second", "third", "fourth" and the like (if present) in the description, claims and the above drawings of the present disclosure are used to distinguish similar objects rather than to describe a specific sequence or order. It should be understood that the data used in this way may be interchanged in suitable situations, such that the embodiments of the present disclosure described herein can be implemented, for example, in a sequence other than those illustrated or described herein. In addition, the terms "comprise" and "have" and any variations of them are intended to cover a non-exclusive inclusion. For example, processes, methods, systems, products, or devices that contain a series of steps or units are not necessarily limited to those steps or units clearly listed, but may include other steps or units that are not clearly listed or are inherent to such processes, methods, products or devices.

The technical solutions of the present disclosure and how the technical solutions of the present application solve the above technical problems will be described in detail below with specific embodiments. The following specific embodiments may be combined with each other, and the same or similar concepts or processes may not be repeated in some embodiments. Embodiments of the present disclosure will be described below with reference to the drawings.

Figure 1:
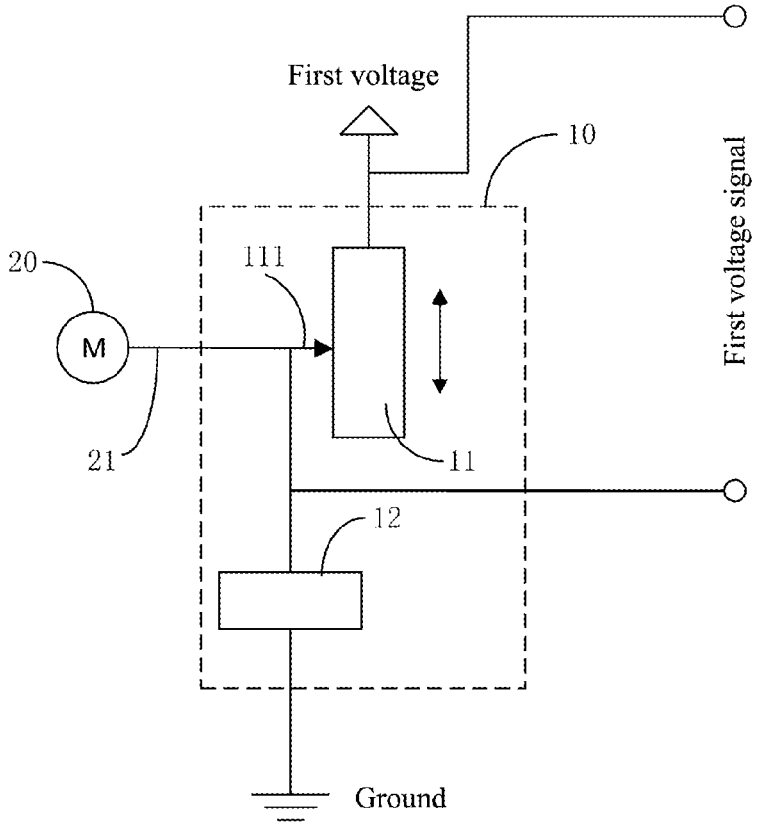
FIG. 1 is a schematic structural diagram of a lock state monitoring apparatus according to Embodiment 1 of the present disclosure.

FIG. 1 is a schematic structural diagram of a lock state monitoring apparatus according to Embodiment 1 of the present disclosure. As shown in FIG. 1, the lock state monitoring apparatus 10 provided in this embodiment includes: a rheostat 11 and a first load 12.

Specifically, a movable contact end 111 of the rheostat 11 is connected to a first end of the first load 12, and a first fixed end of the rheostat 11 and a second end of the first load 12 are configured to bear a first voltage, where the first voltage is a fixed voltage, for example, it can be 3.3 V or other values of voltage. It is worth understanding that the connection between the movable contact end 111 of the rheostat 11 and the first end of the first load 12 is a coupling relationship between electronic devices.

The movable contact end 111 of the rheostat 11 is also configured to be connected with an output axis 21 of a drive motor 20 in the lock, so that the drive motor 20 drives the movable contact end 111 to move, thereby changing a resistance value between the first fixed end and the movable contact end 111 of the rheostat 11. It is worth understanding that the connection between the movable contact end 111 of the rheostat 11 and the output axis 21 of the drive motor 20 is a kinematic pair connection relationship.

For example, the rheostat 11 may be a rotary potentiometer, and a rotating end of the rotary potentiometer is configured to be connected with the output axis 21 of the drive motor 20, so that the rotating end of the rotary potentiometer rotates with the rotation of the output axis 21 of the drive motor 20 to change the resistance value of the rotary potentiometer that is connected in the circuit. It can be seen that when the output axis 21 of the drive motor 20 drives a lock cylinder in the lock to unlock or lock, it also drives the rotating end of the rotary potentiometer to rotate to change the resistance value of the rotary potentiometer that is connected in the circuit.

Figure 2:
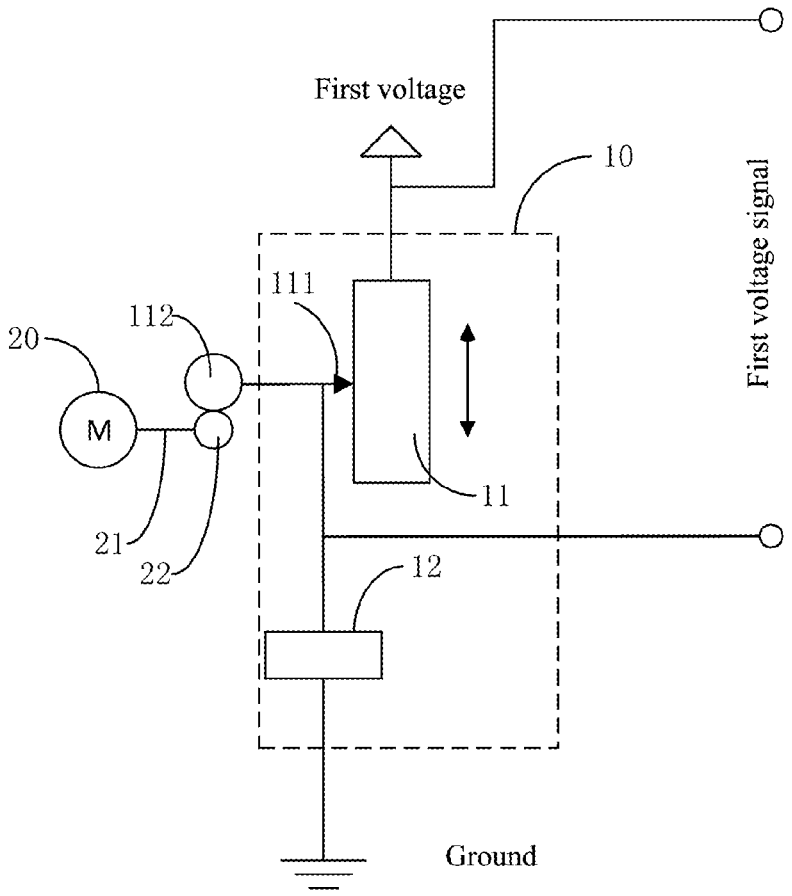
FIG. 2 is a schematic structural diagram of a lock state monitoring apparatus according to Embodiment 2 of the present disclosure.

The connection between the output axis 21 of the drive motor 20 and the rotating end of the rotary potentiometer may be a direct connection through a shaft sleeve or may be a connection through a transmission mechanism, which is not specifically limited in this embodiment. FIG. 2 is a schematic structural diagram of a lock state monitoring apparatus according to Embodiment 2 of the present disclosure. As shown in FIG. 2, in a possible design, a driving gear 22 may be disposed on the output axis 21 of the drive motor 20, and a driven gear 112 which meshes with the driving gear 22 may be disposed at the end of the rotating end of the rotary potentiometer. When the drive motor 20 rotates, the rotating end of the rotary potentiometer is driven by the gear transmission to rotate to change the resistance value of the rotary potentiometer that is connected in the circuit.

In another possible implementation, the rheostat 11 may also be a sliding resistor, and a sliding end of the sliding resistor is configured to be connected with the output axis 21 of the drive motor 20, so that the sliding end of the sliding resistor slides with the output axis 21 of the drive motor 20 to change the resistance value of the sliding resistor. The connection between the drive motor 20 and the sliding end of the sliding resistor may be a connection through a kinematic pair which converts the rotation into the sliding, for example, a gear and rack mechanism. A driving gear may be disposed on the output axis 21 of the drive motor 20, a rack may be disposed on the sliding end of the sliding resistor, and the sliding end of the sliding resistor is driven through the gear and rack to slide to change the resistance value of the sliding resistor that is connected in the circuit.

In addition, the first fixed end and the movable contact end 111 of the rheostat 11, or two ends of the first load 12, are configured to be connected with a main control board in the lock to output a first voltage signal to the main control board, so that the main control board determines a lock state according to the first voltage signal, where the lock state includes: an unlocked state and a locked state.

The specific principle of the main control board determining the lock state according to the first voltage signal will be explained below by combining a specific embodiment.

A first resistor may be selected as the first load 12, the rotary potentiometer may be selected as the rheostat 11, and the resistance value of the first resistor may be assumed to be 2000Ω.

When the lock is in the locked state, the resistance value of the rotary potentiometer is 1000Ω, and the first voltage borne by the first fixed end of the rheostat 11 and the second end of the first load 12 is 3.3V. It can be seen that, at this time, the voltage drop on the rotary potentiometer is 1.1V, while the voltage drop on the first resistor is 2.2V.

In the process of the lock being switched from the locked state to the unlocked state, the drive motor 20 rotates, which drives the rotating end of the rotary potentiometer also to rotate. At this time, taking the resistance of the rotary potentiometer becoming larger with the rotation as an example, when the lock cylinder reaches the maximum position, the drive motor 20 stops rotating. Assuming that the resistance of the rotary potentiometer increases to 4000Ω, at this time, the voltage drop on the rotary potentiometer is 2.2V, and the voltage drop on the first resistor is 1.1V. The maximum position that the lock cylinder reaches may be interpreted as the limiting position that the lock cylinder can reach, which may be, for example, a first position where the lock cylinder is located when the lock is in the unlocked state, or a second position where the lock cylinder is located when the lock is in the locked state.

It can be seen that the lock state can be determined through comparing, by the main control board, the different values of the acquired first voltage signal with the preset value calibrated under each state.

Figure 3:
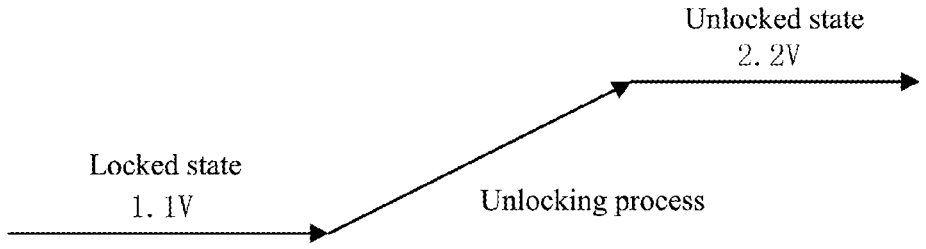
FIG. 3 is a schematic diagram of a possible voltage state in Embodiment 1.

FIG. 3 is a schematic diagram of a possible voltage state in Embodiment 1. As shown in FIG. 3, in this embodiment, the lock state can be determined by monitoring the change of the voltage between the first fixed end and the movable contact end of the rheostat 11. When the lock state is the locked state, the voltage drop on the rotary potentiometer is 1.1V; in the process of the lock being switched from the locked state to the unlocked state, the voltage drop on the rotary potentiometer gradually rises until the lock cylinder reaches to the maximum position when the drive motor 20 stops rotating, the voltage drop on the rotary potentiometer is 2.2V and the lock is in the unlocked state. It can be seen that the lock state can be determined through comparing, by the main control board, the different values of the acquired first voltage signal between the first fixed end and the movable contact end 111 of the rheostat 11 with the preset value calibrated under each state.

In addition, since a processor on the main control board needs to convert an analog signal into a digital signal for processing, the acquired first voltage signal can be processed by an analog-to-digital converter, that is, the first voltage signal is converted into a first digital signal and the first digital signal is inputted to a first port of the main control board.

Specifically, in a possible setting manner, when the lock cylinder is at the first position, the first voltage signal is a first value, at this time, the first digital signal after the analog-to-digital conversion according to the first value is a high level, and then the lock state is determined to be the unlocked state; when the lock cylinder is at the second position, the first voltage signal is a second value, at this time, the first digital signal after the analog-to-digital conversion according to the second value is a low level, and then the lock state is determined to be the locked state.

In another possible setting manner, when the lock cylinder is at the first position, the first voltage signal is the first value, at this time, the first digital signal after the analog-to-digital conversion according to the first value is a low level, and then the lock state is determined to be the unlocked state; when the lock cylinder is at the second position, the first voltage signal is the second value, at this time, the first digital signal after the analog-to-digital conversion according to the second value is a high level, and then the lock state is determined to be the locked state.

In this embodiment, by connecting the portion of the rheostat that is connected in the circuit with the first load in series, then loading the stable first voltage on the portion of the rheostat that is connected in the circuit and the first load, and connecting the movable contact end of the rheostat with the output axis of the drive motor in the lock, when the lock performs unlocking/locking operations using the drive motor, the resistance value of the portion of the rheostat that is connected in the circuit is also changed at the same time, thereby the first voltage signal between the first fixed end and the movable contact end of the rheostat or between two ends of the first load is changed; and the first voltage signal is sent to the main control board on the lock, thereby the main control board compares the different values corresponding to the current first voltage signal with the preset value calibrated under each state to realize the determining of the lock state. Through the strong coupling linkage relationship between the rotation of the drive motor and the resistance value of the rheostat, accurate monitoring of the lock state can be realized only by adding simple devices, and adaptation to locks of different types can be realized, thereby greatly reducing development and production costs of the locks.

It is worth noting that the lock state monitoring apparatus provided in this embodiment may be an integrated module. During the design process of a lock, a corresponding mounting position may be set and a circuit connection interface may be disposed, and then the lock state monitoring apparatus is mounted into the lock, so that the lock state monitoring apparatus is connected with a controller, the drive motor and a power supply. In addition, the state monitoring apparatus provided in this embodiment may also be applied to the modification of an ordinary intelligent lock. By disposing the state monitoring apparatus provided by this embodiment outside the ordinary intelligent lock, and establishing the kinematic pair connection between the lock cylinder of the ordinary intelligent lock and the movable contact end of the rheostat, the state monitoring for the ordinary intelligent lock by the external state monitoring apparatus can be realized.

Figure 4:
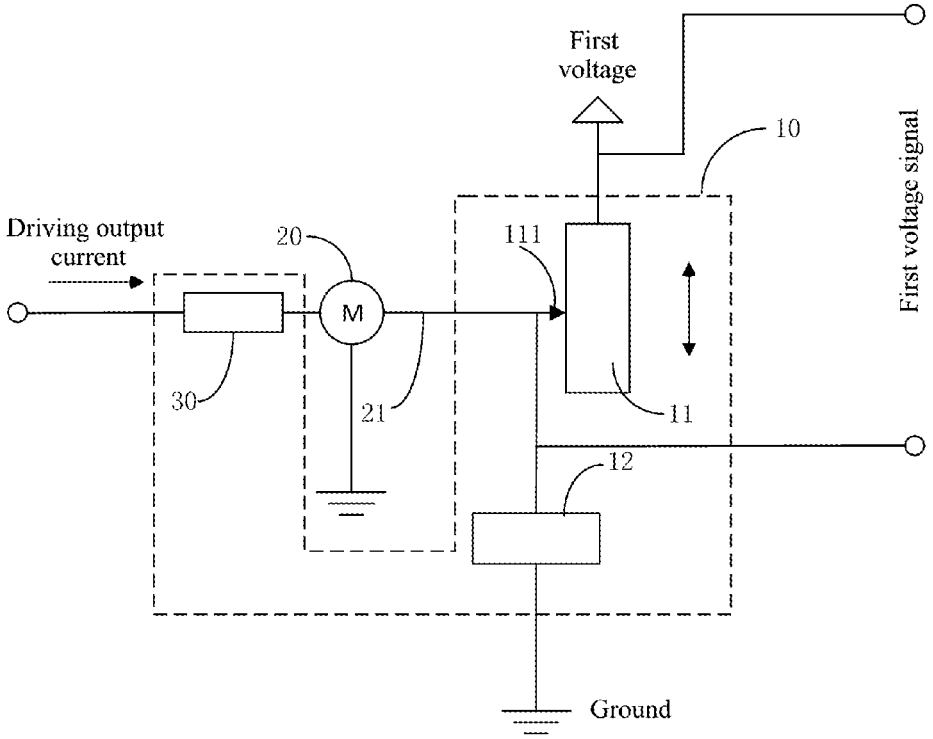
FIG. 4 is a schematic structural diagram of a lock state monitoring apparatus according to Embodiment 3 of the present disclosure.

On the basis of the embodiment shown in FIG. 1, FIG. 4 is a schematic structural diagram of a lock state monitoring apparatus according to Embodiment 3 of the present disclosure. As shown in FIG. 4, the lock state monitoring apparatus provided in this embodiment further includes: a second load 30.

A first end of the second load 30 is configured to be connected with a first input of the drive motor 20, so that a driving output current drives the drive motor 20 after flowing through the second load 30. It is worth understanding that when the drive motor 20 is not working, its driving output current is 0; when the main control board controls the drive motor 20 to rotate and it is in the process of switching between different states of the lock, the driving output current is the normal working current of the drive motor 20; and when the lock cylinder rotates to a clamping position, whether it is an unlocked state clamping position or a locked state clamping position, at this time, the resistance suffered by the drive motor 20 will increase, and the power required by the drive motor 20 also increases naturally, which then makes the driving output current at this time increase rapidly, thereby the voltage drop between two ends of the second load 30 increases. Two ends of the second load 30 are configured to be connected with the main control board to output a second voltage signal to the main control board, so that the main control board determines, according to the second voltage signal, whether the lock reaches the clamping position.

The specific principle of the main control board determining whether the lock reaches the clamping position according to the second voltage signal will be explained below by combining a specific embodiment.

A second resistor may be selected as the second load 30, and the resistance value of the second resistor may be assumed to be 10Ω.

Figure 5:
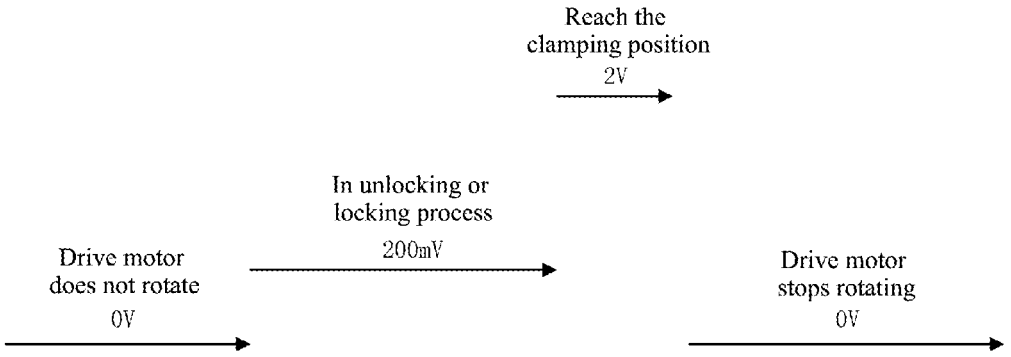
FIG. 5 is a schematic diagram of a possible voltage state in Embodiment 3.

FIG. 5 is a schematic diagram of a possible voltage state in Embodiment 3. As shown in FIG. 5, when the lock is in the locked state or the unlocked state, the drive motor 20 is not working, and the driving output current is 0; correspondingly, at this time, the voltage drop between two ends of the second load 30 is also 0V.

When the main control board controls the drive motor 20 to move to switch the lock state, for example, from the unlocked state to the locked state, at this time, the drive motor 20 starts to rotate, and it can be assumed that at this time the normal working current of the drive motor 20 is 20 mA, that is, the driving output current is 20 mA, and correspondingly, the voltage drop between two ends of the second load 30 is also 200 mV. When the drive motor 20 continues rotating until the lock cylinder moves to the limiting position, that is, the lock reaches the clamping position, the resistance suffered by the drive motor 20 will increase, and the power required by the drive motor 20 also increases naturally, which then makes the driving output current at this time increases rapidly, for example, to 200 mA, thereby the voltage drop between two ends of the second load 30 rises to 2V. After acquiring the second voltage signal between two ends of the second load 30, the acquired second voltage signal can be compared with the preset voltage value calibrated under each state to determine a clamping position state of the lock assembly, where the above clamping position state includes: a clamping position reaching state and a clamping position non-reaching state.

Since the processor on the main control board needs to convert the analog signal into the digital signal for processing, the acquired second voltage signal can be processed by the analog-to-digital converter, that is, the second voltage signal is converted into a second digital signal and the second digital signal is inputted to a second port of the main control board.

Optionally, if the clamping position state is determined by acquiring a multiple between a voltage value corresponding to the second voltage signal and a preset voltage value, when the multiple is greater than a preset multiple, the second digital signal after the analog-to-digital conversion is a high level, and then the clamping position state can be determined to be the clamping position reaching state; and when the multiple is less than or equal to the preset multiple, the second digital signal after the analog-to-digital conversion is a low level, and then the clamping position state can be determined to be the clamping position non-reaching state.

Optionally, if the clamping position state is determined by acquiring the multiple between the voltage value corresponding to the second voltage signal and the preset voltage value, when the multiple is greater than the preset multiple, the second digital signal after the analog-to-digital conversion is a low level, and then the clamping position state can be determined to be the clamping position reaching state; and when the multiple is less than or equal to the preset multiple, the second digital signal after the analog-to-digital conversion is a high level, and then the clamping position state can be determined to be the clamping position non-reaching state.

Optionally, if the clamping position state is determined by acquiring a difference value between the voltage value corresponding to the second voltage signal and a preset voltage value, when the difference value is greater than a preset difference value, the second digital signal after the analog-to-digital conversion is a high level, and then the clamping position state can be determined to be the clamping position reaching state; and when the difference value is less than or equal to the preset difference value, the second digital signal after the analog-to-digital conversion is a low level, and then the clamping position state can be determined to be the clamping position non-reaching state.

Optionally, if the clamping position state is determined by acquiring the difference value between the voltage value corresponding to the second voltage signal and the preset voltage value, when the difference value is greater than the preset difference value, the second digital signal after the analog-to-digital conversion is a low level, and then the clamping position state can be determined to be the clamping position reaching state; and when the difference value is less than or equal to the preset difference value, the second digital signal after the analog-to-digital conversion is a high level, and then the clamping position state can be determined to be the clamping position non-reaching state.

In this embodiment, the second voltage signal of the second load in different states is acquired by connecting the second load in series with the drive motor and combining the driving output current characteristics of the drive motor under different working states, and the second voltage signal is outputted to the main control board of the lock, so that the main control board determines whether the lock reaches the clamping position according to the second voltage signal. The circuit structure is simple, and adaptation to locks of different types can be realized, thereby greatly reducing development and production costs of the locks.

It is worth noting that the lock state monitoring apparatus provided in any one of the above embodiments may be an integrated module. During the design process of a lock, a corresponding mounting position may be set and a circuit connection interface may be disposed, and then the lock state monitoring apparatus is mounted into the lock, so that the lock state monitoring apparatus is connected with the controller, the drive motor and the power supply. In addition, the lock state monitoring apparatus provided in any one of the above embodiments may be integrated with the drive motor as an integrated module, i.e., a lock driving apparatus, and then the functions of the lock cylinder driving and the lock state monitoring can be realized by directly mounting the lock driving apparatus into the lock.

In addition, an embodiment of the present disclosure further provides a lock assembly, including: a main control board, a drive motor 20, a lock cylinder, and any one of the lock state monitoring apparatuses provided in the above embodiments, where the main control board is connected with the drive motor 20, and the main control board is configured to control the drive motor 20 to rotate; and an output axis 21 of the drive motor 20 is connected with the lock cylinder, so that the lock cylinder moves between the first position and the second position under the action of the drive motor 20. When the lock cylinder is at the first position, the state of the lock assembly is the unlocked state, and when the lock cylinder is at the second position, the state of the lock assembly is the locked state. For the principle and process of monitoring the state of the lock assembly using the lock state monitoring apparatus, please refer to the working principle of the lock state monitoring apparatus provided in the above embodiments, which will not be repeated in this embodiment.

Figure 6:
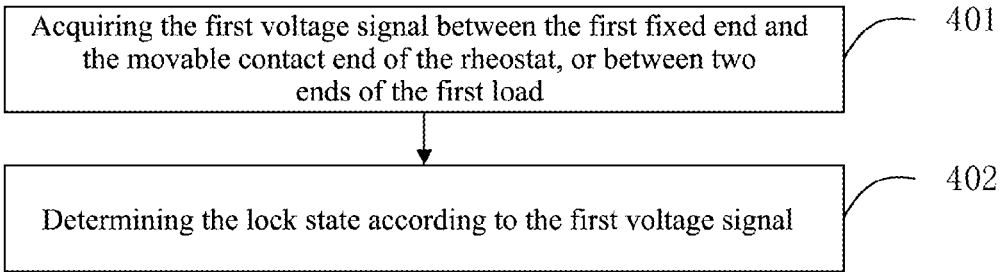
FIG. 6 is a flowchart of a lock state monitoring method according to Embodiment 4 of the present disclosure.

FIG. 6 is a flowchart of a lock state monitoring method provided in Embodiment 4 of the present disclosure. As shown in FIG. 6, the lock state monitoring method provided in this embodiment is applied to the lock state monitoring apparatus provided by any one of the above embodiments, where specifically, the lock state monitoring method provided by the embodiment includes:

Step 401: acquiring the first voltage signal between the first fixed end and the movable contact end of the rheostat, or between two ends of the first load.

The first fixed end and the movable contact end 111 of the rheostat 11, or two ends of the first load 12, are configured to be connected with the main control board in the lock to output the first voltage signal to the main control board. The movable contact end 111 of the rheostat 11 is configured to be connected with the output axis 21 of the drive motor 20 in the lock, and when in different lock states, the output axis 21 of the drive motor 20 rotates to different angles, which makes the resistance values of the rheostat 11 that are connected in the circuit also different. The rheostat 11 may be a rotary potentiometer, and the rotating end of the rotary potentiometer is configured to be connected with the output axis 21 of the drive motor 20, so that the rotating end of the rotary potentiometer rotates with the output axis 21 of the drive motor 20 to change the resistance value of the rotary potentiometer that is connected in the circuit. It can be seen that when the output axis 21 of the drive motor 20 drives the lock cylinder in the lock to unlock or lock, it also drives the rotating end of the rotary potentiometer to rotate to change the resistance value of the rotary potentiometer that is connected in the circuit.

The connection between the output axis 21 of the drive motor 20 and the rotating end of the rotary potentiometer may be a direct connection through a shaft sleeve or may be a connection through a transmission mechanism, which is not specifically limited in this embodiment. Continuing to refer to FIG. 2, in a possible design, a driving gear 22 may be disposed on the output axis 21 of the drive motor 20, and a driven gear 112 which meshes with the driving gear 22 may be disposed at the end of the rotating end of the rotary potentiometer. When the drive motor 20 rotates, the rotating end of the rotary potentiometer is driven by the gear transmission to rotate to change the resistance value of the rotary potentiometer that is connected in the circuit.

In another possible implementation, the rheostat 11 may also be a sliding resistor, and a sliding end of the sliding resistor is configured to be connected with the output axis 21 of the drive motor 20, so that the sliding end of the sliding resistor slides with the output axis 21 of the drive motor 20 to change the resistance value of the sliding resistor that is connected in the circuit. The connection between the drive motor 20 and the sliding end of the sliding resistor may be a connection through a kinematic pair which converts the rotation into the sliding, for example, a gear and rack mechanism. A driving gear may be disposed on the output axis 21 of the drive motor 20, a rack may be disposed on the sliding end of the sliding resistor, and the sliding end of the sliding resistor is driven through the gear and rack to slide to change the resistance value of the sliding resistor that is connected in the circuit.

Step 402: determining the lock state according to the first voltage signal.

The first fixed end and the movable contact end of the rheostat 11, or two ends of the first load 12, are configured to be connected with the main control board in the lock to output the first voltage signal to the main control board, so that the main control board determines the lock state according to the first voltage signal, where the lock state includes: the unlocked state and the locked state.

The specific principle of the main control board determining the lock state according to the first voltage signal will be explained below by combining a specific embodiment.

A first resistor may be selected as the first load 12, the rotary potentiometer may be selected as the rheostat 11, and the resistance value of the first resistor may be assumed to be 2000Ω.

When the lock is in the locked state, the resistance of the rotary potentiometer is 1000Ω, and the first voltage borne by the first fixed end of the rheostat 11 and the second end of the first load 12 is 3.3V. It can be seen that, at this time, the voltage drop on the rotary potentiometer is 1.1V, while the voltage drop on the first resistor is 2.2V.

In the process of the lock being switched from the locked state to the unlocked state, the drive motor 20 rotates, which drives the rotating end of the rotary potentiometer also to rotate. At this time, taking the resistance of the rotary potentiometer becoming larger with the rotation as an example, when the lock cylinder reaches the maximum position, the drive motor 20 stops rotating. At this time, assuming that the resistance value of the rotary potentiometer increases to 4000Ω, then at this time, the voltage drop on the rotary potentiometer is 2.2V, and the voltage drop on the first resistor is 1.1V.

It can be seen that the lock state can be determined through comparing, by the main control board, the different values of the acquired first voltage signal with the preset value calibrated under each state.

In addition, since a processor on the main control board needs to convert an analog signal into a digital signal for processing, the acquired first voltage signal can be processed by an analog-to-digital converter, that is, the first voltage signal is converted into a first digital signal and the first digital signal is inputted to a first port of the main control board.

Specifically, in a possible setting manner, when the lock cylinder is at a first position, the first voltage signal is a first value, at this time, the first digital signal after the analog-to-digital conversion according to the first value is a high level, and then the lock state is determined to be the unlocked state; when the lock cylinder is at the second position, the first voltage signal is a second value, at this time, the first digital signal after the analog-to-digital conversion according to the second value is a low level, and then the lock state is determined to be the locked state.

In another possible setting manner, when the lock cylinder is at the first position, the first voltage signal is the first value, at this time, the first digital signal after the analog-to-digital conversion according to the first value is a low level, and then the lock state is determined to be the unlocked state; when the lock cylinder is at the second position, the first voltage signal is the second value, at this time, the first digital signal after the analog-to-digital conversion according to the second value is a high level, and then the lock state is determined to be the locked state.

In this embodiment, by connecting the portion of the rheostat that is connected in the circuit with the first load in series, then loading the stable first voltage on the portion of the rheostat that is connected in the circuit and the first load, and connecting the movable contact end of the rheostat with the output axis of the drive motor in the lock, when the lock performs unlocking/locking operations using the drive motor, the resistance value of the portion of the rheostat that is connected in the circuit is also changed at the same time, thereby the first voltage signal between the first fixed end and the movable contact end of the rheostat or between two ends of the first load is changed; and the first voltage signal is sent to the main control board on the lock, thereby the main control board compares the different values corresponding to the current first voltage signal with the preset value calibrated under each state to realize the determining of the lock state. Through the strong coupling linkage relationship between the rotation of the drive motor and the resistance value of the rheostat, accurate monitoring of the lock state can be realized only by adding simple devices, and adaptation to locks of different types can be realized, thereby greatly reducing development and production costs of the locks.

Figure 7:
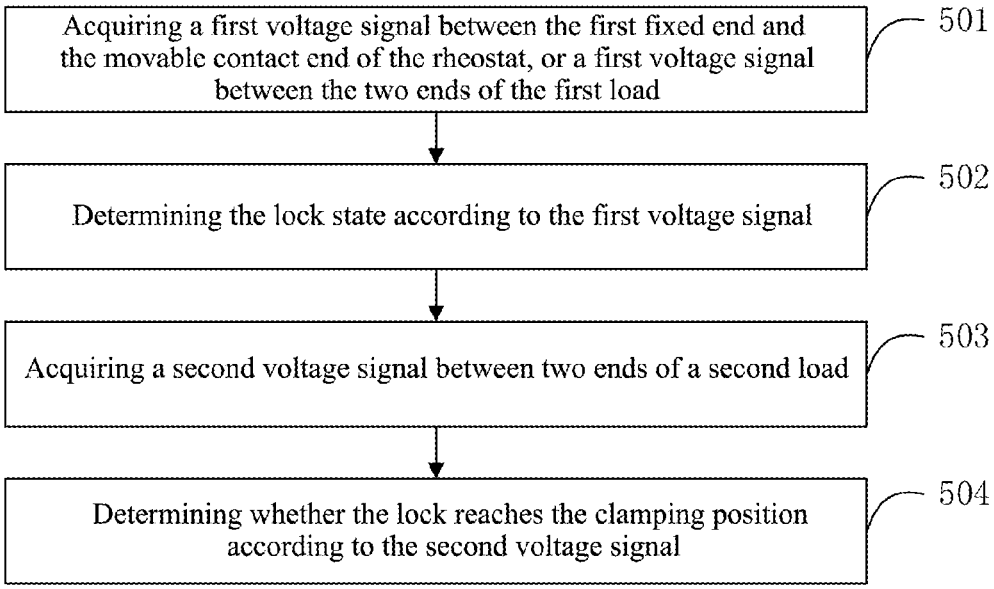
FIG. 7 is a flowchart of a lock state monitoring method according to Embodiment 5 of the present disclosure.

FIG. 7 is a flowchart of a lock state monitoring method according to Embodiment 5 of the present disclosure. As shown in FIG. 7, the lock state monitoring method provided in this embodiment is applied to the lock, and the lock further includes a second load 30. A first end of the second load 30 is configured to be connected with a first input of the drive motor 20, so that a driving output current drives the drive motor 20 after flowing through the second load 30. The lock state monitoring method provided in this embodiment includes:

Step 501: acquiring the first voltage signal between the first fixed end and the movable contact end of the rheostat, or between two ends of the first load.

Step 502: determining the lock state according to the first voltage signal.

It is worth noting that for the specific implementations of the steps 501-502, please refer to the description of the steps 401-402 in the embodiment shown in FIG. 5, and details are not repeated here.

Step 503: acquiring a second voltage signal between two ends of a second load.

When the drive motor 20 is not working, its driving output current is 0; when the main control board controls the drive motor 20 to rotate and it is in the process of switching between different states of the lock, the driving output current is the normal working current of the drive motor 20; and when the lock cylinder rotates to a clamping position, whether it is an unlocked state clamping position or a locked state clamping position, at this time, the resistance suffered by the drive motor 20 will increase, and the power required by the drive motor 20 also increases naturally, which then makes the driving output current at this time increase rapidly, thereby the voltage drop between two ends of the second load 30 increases.

Step 504: determining whether the lock reaches the clamping position according to the second voltage signal.

Using the above working characteristics of the drive motor 20, two ends of the second load 30 may be configured to be connected with the main control board to output the second voltage signal to the main control board, so that the main control board determines whether the lock reaches the clamping position according to the second voltage signal.

The specific principle of the main control board determining whether the lock reaches the clamping position according to the second voltage signal will be explained below by combining a specific embodiment.

A second resistor may be selected as the second load 30, and the resistance value of the second resistor may be assumed to be 10Ω.

Continuing to refer to FIG. 5, when the lock is in the locked state or the unlocked state, the drive motor 20 is not working, and the driving output current is 0; correspondingly, at this time, the voltage drop between two ends of the second load 30 is also 0V. When the main control board controls the drive motor 20 to move to switch the lock state, for example, from the unlocked state to the locked state, at this time, the drive motor 20 starts to rotate, and it can be assumed that at this time the normal working current of the drive motor 20 is 20 mA, that is, the driving output current is 20 mA, and correspondingly, the voltage drop between two ends of the second load 30 is also 200 mV. When the drive motor 20 continues rotating until the lock cylinder moves to the limiting position, that is, the lock reaches the clamping position, the resistance suffered by the drive motor 20 will increase, and the power required by the drive motor 20 also increases naturally, which then makes the driving output current at this time increases rapidly, for example, to 200 mA, thereby the voltage drop between two ends of the second load 30 rises to 2V. After acquiring the second voltage signal between two ends of the second load 30, the acquired second voltage signal can be compared with the preset voltage value calibrated under each state to determine a clamping position state of the lock assembly, where the above clamping position state includes: a clamping position reaching state and a clamping position non-reaching state.

Since the processor on the main control board needs to convert the analog signal into the digital signal for processing, the acquired second voltage signal can be processed by the analog-to-digital converter, that is, the second voltage signal is converted into a second digital signal and the second digital signal is inputted to a second port of the main control board.

Optionally, if the clamping position state is determined by acquiring a multiple between a voltage value corresponding to the second voltage signal and a preset voltage value, when the multiple is greater than a preset multiple, the second digital signal after the analog-to-digital conversion is a high level, and then the clamping position state can be determined to be the clamping position reaching state; and when the multiple is less than or equal to the preset multiple, the second digital signal after the analog-to-digital conversion is a low level, and then the clamping position state can be determined to be the clamping position non-reaching state.

Optionally, if the clamping position state is determined by acquiring the multiple between the voltage value corresponding to the second voltage signal and the preset voltage value, when the multiple is greater than the preset multiple, the second digital signal after the analog-to-digital conversion is a low level, and then the clamping position state can be determined to be the clamping position reaching state; and when the multiple is less than or equal to the preset multiple, the second digital signal after the analog-to-digital conversion is a high level, and then the clamping position state can be determined to be the clamping position non-reaching state.

Optionally, if the clamping position state is determined by acquiring a difference value between the voltage value corresponding to the second voltage signal and a preset voltage value, when the difference value is greater than a preset difference value, the second digital signal after the analog-to-digital conversion is a high level, and then the clamping position state can be determined to be the clamping position reaching state; and when the difference value is less than or equal to the preset difference value, the second digital signal after the analog-to-digital conversion is a low level, and then the clamping position state can be determined to be the clamping position non-reaching state.

Optionally, if the clamping position state is determined by acquiring the difference value between the voltage value corresponding to the second voltage signal and the preset voltage value, when the difference value is greater than the preset difference value, the second digital signal after the analog-to-digital conversion is a low level, and then the clamping position state can be determined to be the clamping position reaching state; and when the difference value is less than or equal to the preset difference value, the second digital signal after the analog-to-digital conversion is a high level, and then the clamping position state can be determined to be the clamping position non-reaching state.

In this embodiment, the second voltage signal of the second load in different states is acquired by connecting the second load in series with the drive motor and combining the driving output current characteristics of the drive motor under different working states, and the second voltage signal is outputted to the main control board of the lock, so that the central control board determines whether the lock reaches the clamping position according to the second voltage signal. The circuit structure is simple, and adaptation to locks of different types can be realized, thereby greatly reducing development and production costs of the locks.

Figure 8:
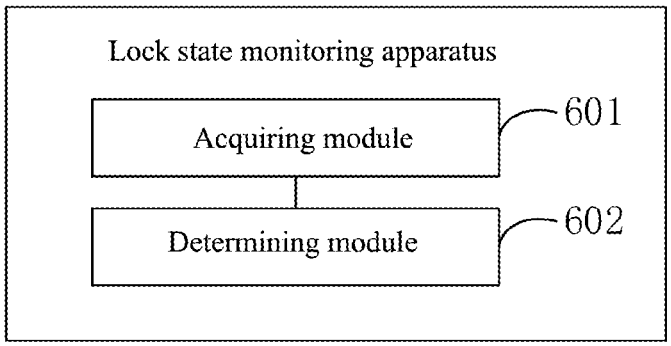
FIG. 8 is a schematic structural diagram of a lock state monitoring apparatus according to Embodiment 6 of the present disclosure.

FIG. 8 is a schematic structural diagram of a lock state monitoring apparatus according to Embodiment 6 of the present disclosure. As shown in FIG. 8, the lock state monitoring apparatus provided in this embodiment includes:

an acquiring module 601, configured to acquire a first voltage signal between a first fixed end and a movable contact end of a rheostat, or between two ends of a first load; and a determining module 602, configured to determine a lock state according to the first voltage signal, where the lock state includes: an unlocked state and a locked state.

In a possible design, the determining module 601 is specifically configured to:

convert the first voltage signal into a first digital signal; and determine the lock state according to the first digital signal, where a main control board acquires the first digital signal through a first port.

In a possible design, the acquiring module 601 is specifically configured to:

in a case that the first voltage signal is a first value as the lock cylinder is located at the first position, determine the lock state to be the unlocked state when the first digital signal is a high level;

in a case that the first voltage signal is a second value as the lock cylinder is located at the second position, determine the lock state to be the locked state when the first digital signal is a low level;

or, in a case that the first voltage signal is a first value as the lock cylinder is located at the first position, determine the lock state to be the unlocked state when the first digital signal is a low level;

in a case that the first voltage signal is a second value as the lock cylinder is located at the second position, determine the lock state to be the locked state when the first digital signal is a high level.

In a possible design, the acquiring module 601 is further configured to acquire a second voltage signal between two ends of the second load, and a first end of the second load is configured to be connected with a first input of the drive motor, so that a driving output current drives the drive motor after flowing through the second load; and the determining module 602 is further configured to determine a clamping position state of the lock assembly according to the second voltage signal, where the clamping position state includes: a clamping position reaching state and a clamping position non-reaching state.

In a possible design, the determining module 602 is specifically configured to:

convert the second voltage signal into a second digital signal; and determine the clamping position state according to the second digital signal, where the main control board acquires the second digital signal through a second port.

In a possible design, the determining module 602 is specifically configured to:

if the clamping position state is determined by acquiring a multiple between a voltage value corresponding to the second voltage signal and a preset voltage value; then determine the clamping position state to be the clamping position reaching state, when the second digital signal is a high level as the multiple is greater than a preset multiple;

determine the clamping position state to be the clamping position non-reaching state, when the second digital signal is a low level as the multiple is less than or equal to the preset multiple;

or, determine the clamping position state to be the clamping position reaching state, when the second digital signal is a low level as the multiple is greater than the preset multiple;

determine the clamping position state to be the clamping position non-reaching state, when the second digital signal is a high level as the multiple is less than or equal to the preset multiple;

if the clamping position state is determined by acquiring a difference value between the voltage value corresponding to the second voltage signal and a preset voltage value; then determine the clamping position state to be the clamping position reaching state, when the second digital signal is a high level as the difference value is greater than a preset difference value;

determine the clamping position state to be the clamping position non-reaching state, when the second digital signal is a low level as the difference value is less than or equal to the preset difference value;

or, determine the clamping position state to be the clamping position reaching state, when the second digital signal is a low level as the difference value is greater than the preset difference value;

determine the clamping position state to be the clamping position non-reaching state, when the second digital signal is a high level as the difference value is less than or equal to the preset difference value.

It is worth noting that the lock state monitoring apparatus provided in the embodiment shown in FIG. 8 is used to perform the lock state monitoring method provided in any one of the above embodiments.

Figure 9:
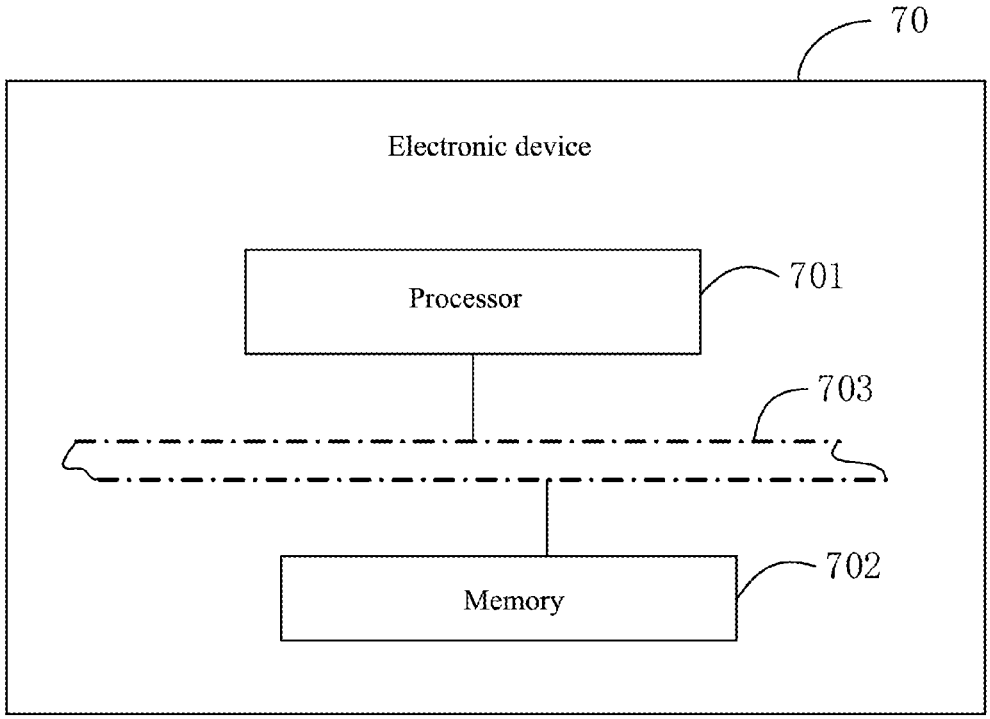
FIG. 9 is a schematic structural diagram of an electronic device according to Embodiment 7 of the present disclosure.

FIG. 9 is a schematic structural diagram of an electronic apparatus according to Embodiment 7 of the present disclosure. As shown in FIG. 9, the electronic device 70 in this embodiment can include: a processor 701 and a memory 702;

where the memory 702 is configured to store a program; and the processor 701 is configured to execute the program stored in the memory 702, and when the program is executed, the processor 701 is configured to execute any of the above method embodiments to monitor the lock state of the lock.

Optionally, the memory 702 may be either independent or integrated with the processor 701.

When the memory 702 is a device independent of the processor 701, the electronic device 70 may further include: a bus 703, configured to connect the memory 702 and the processor 701.

An embodiment of the present disclosure further provides a computer readable storage medium, including: instructions which, when run on a computer, cause the computer to perform any of the above method embodiments to monitor the lock state of the lock assembly.

The computer readable medium includes a computer storage medium and a communication medium, where the communication medium includes any medium that facilitates the computer program being transferring from one place to another. The storage medium may be any available media that can be accessed by a general-purpose or special-purpose computer. An exemplary storage medium is coupled to the processor to enable the processor to read information from and write information to the storage medium. Of course, the storage medium may also be a part of the processor. The processor and the storage medium may be located in an application specific integrated circuit (ASIC). In addition, the application specific integrated circuit may be located in a user equipment. Of course, the processor and the storage medium may also exist as discrete components in a communication device.

After considering the specification and practicing the disclosures disclosed herein, those skilled in the art will easily think of other implementations of the present disclosure. The present disclosure is intended to cover any variations, uses, or adaptations of the present disclosure, which are in accordance with the general principles of the present disclosure and include common knowledge or conventional technical means in the art that are not disclosed in the present disclosure. The specification and embodiments are regarded as illustrative only, and the true scope and spirit of the present disclosure are indicated by the following claims.

It should be understood that the present disclosure is not limited to the precise structures described above and shown in the accompanying drawings, and various modifications and changes can be made without departing from the scope thereof. The scope of the present disclosure is to be limited only by the appended claims.

What is claimed is:

1. A lock state monitoring apparatus, wherein the apparatus is applied to a lock, and the apparatus comprises: a rheostat and a first load;

a movable contact end of the rheostat is connected with a first end of the first load, and a first fixed end of the rheostat and a second end of the first load are configured to bear a first voltage;

the movable contact end of the rheostat is configured to be connected with an output axis of a drive motor in the lock, so that the drive motor drives the movable contact end to move to change a resistance value between the first fixed end and the movable contact end;

the first fixed end and the movable contact end, or two ends of the first load, are configured to be connected with a main control board in the lock to output a first voltage signal to the main control board, so that the main control board determines a lock state according to the first voltage signal, wherein the lock state comprises: an unlocked state and a locked state;

wherein the apparatus further comprises: a second load;

a first end of the second load is configured to be connected with a first input of the drive motor, so that a driving output current drives the drive motor after flowing through the second load;

two ends of the second load are configured to be connected with the main control board to output a second voltage signal to the main control board, so that the main control board determines, according to the second voltage signal, whether the lock reaches a clamping position.

2. The lock state monitoring apparatus according to claim 1, wherein the rheostat is a rotary potentiometer, and the movable contact end is a rotating end of the rotary potentiometer;

the rotating end is configured to be connected with the output axis of the drive motor, so that the rotating end rotates with the output axis of the drive motor to change a resistance value of the rotary potentiometer that is connected in a circuit.

3. The lock state monitoring apparatus according to claim 2, wherein the first load is a first resistor.

4. The lock state monitoring apparatus according to claim 1, wherein the second load is a second resistance.

5. A lock driving apparatus, comprising: a drive motor, and the lock state monitoring apparatus according to claim 1.

6. A lock assembly, comprising: a main control board, a drive motor, a lock cylinder, and the lock state monitoring apparatus according to claim 1;

wherein the main control board is connected with the drive motor to control the drive motor to rotate;

the output axis of the drive motor is connected with the lock cylinder, so that the lock cylinder moves between a first position and a second position under action of the drive motor;

when the lock cylinder is located at the first position, the lock state is the unlocked state, and when the lock cylinder is located at the second position, the lock state is the locked state.

7. A lock state monitoring method, wherein the method is applied to the lock assembly according to claim 6, and the method comprises:

acquiring the first voltage signal between the first fixed end and the movable contact end of the rheostat, or between the two ends of the first load; and determining the lock state according to the first voltage signal;

wherein the method further comprises:

acquiring a second voltage signal between two ends of a second load, wherein a first end of the second load is configured to be connected with a first input of the drive motor, so that a driving output current drives the drive motor after flowing through the second load; and determining a clamping position state of the lock assembly according to the second voltage signal, wherein the clamping position state comprises: a clamping position reaching state and a clamping position non-reaching state.

8. The lock state monitoring method according to claim 7, wherein the determining the lock state according to the first voltage signal comprises:

converting the first voltage signal into a first digital signal; and determining the lock state according to the first digital signal, wherein the main control board acquires the first digital signal through a first port.

9. The lock state monitoring method according to claim 8, wherein the determining the lock state according to the first digital signal comprises:

in a case that the first voltage signal is a first value as the lock cylinder is located at the first position, determining the lock state to be the unlocked state when the first digital signal is a high level;

in a case that the first voltage signal is a second value as the lock cylinder is located at the second position, determining the lock state to be the locked state when the first digital signal is a low level;

or, in a case that the first voltage signal is a first value as the lock cylinder is located at the first position, determining the lock state to be the unlocked state when the first digital signal is a low level;

in a case that the first voltage signal is a second value as the lock cylinder is located at the second position, determining the lock state to be the locked state when the first digital signal is a high level.

10. The lock state monitoring method according to claim 7, wherein the determining a clamping position state of the lock assembly according to the second voltage signal comprises:

converting the second voltage signal into a second digital signal; and determining the clamping position state according to the second digital signal, wherein the main control board acquires the second digital signal through a second port.

11. The lock state monitoring method according to claim 10, wherein the determining the clamping position state according to the second digital signal comprises:

if the clamping position state is determined by acquiring a multiple between a voltage value corresponding to the second voltage signal and a preset voltage value; then determining the clamping position state to be the clamping position reaching state, when the second digital signal is a high level as the multiple is greater than a preset multiple;

determining the clamping position state to be the clamping position non-reaching state, when the second digital signal is a low level as the multiple is less than or equal to the preset multiple;

or, determining the clamping position state to be the clamping position reaching state, when the second digital signal is a low level as the multiple is greater than a preset multiple;

determining the clamping position state to be the clamping position non-reaching state, when the second digital signal is a high level as the multiple is less than or equal to the preset multiple;

if the clamping position state is determined by acquiring a difference value between the voltage value corresponding to the second voltage signal and the preset voltage value; then determining the clamping position state to be the clamping position reaching state, when the second digital signal is a high level as the difference value is greater than a preset difference value;

determining the clamping position state to be the clamping position non-reaching state, when the second digital signal is a low level as the difference value is less than or equal to the preset difference value;

or, determining the clamping position state to be the clamping position reaching state, when the second digital signal is a low level as the difference value is greater than a preset difference value;

determining the clamping position state to be the clamping position non-reaching state, when the second digital signal is a high level as the difference value is less than or equal to the preset difference value.

12. An electronic device, comprising:

a memory, configured to store a program; and a processor, configured to execute the program stored in the memory, wherein when the program is executed, the processor is configured to use the lock state monitoring method according to claim 8 to monitor the lock state of the lock assembly;

wherein the processor is further configured to:

acquire a second voltage signal between two ends of a second load, wherein a first end of the second load is configured to be connected with a first input of the drive motor, so that a driving output current drives the drive motor after flowing through the second load; and determine a clamping position state of the lock assembly according to the second voltage signal, wherein the clamping position state comprises: a clamping position reaching state and a clamping position non-reaching state.

13. The electronic device according to claim 12, wherein the processor is configured to:

convert the first voltage signal into a first digital signal; and determine the lock state according to the first digital signal, wherein the main control board acquires the first digital signal through a first port.

14. The electronic device according to claim 13, wherein the processor is further configured to:

in a case that the first voltage signal is a first value as the lock cylinder is located at the first position, determine the lock state to be the unlocked state when the first digital signal is a high level;

in a case that the first voltage signal is a second value as the lock cylinder is located at the second position, determine the lock state to be the locked state when the first digital signal is a low level;

or, in a case that the first voltage signal is a first value as the lock cylinder is located at the first position, determine the lock state to be the unlocked state when the first digital signal is a low level;

in a case that the first voltage signal is a second value as the lock cylinder is located at the second position, determine the lock state to be the locked state when the first digital signal is a high level.

15. The electronic device according to claim 12, wherein the processor is further configured to:

convert the second voltage signal into a second digital signal; and determine the clamping position state according to the second digital signal, wherein the main control board acquires the second digital signal through a second port.

16. The electronic device according to claim 15, wherein the processor is further configured to:

if the clamping position state is determined by acquiring a multiple between a voltage value corresponding to the second voltage signal and a preset voltage value; then determining the clamping position state to be the clamping position reaching state, when the second digital signal is a high level as the multiple is greater than a preset multiple;

determining the clamping position state to be the clamping position non-reaching state, when the second digital signal is a low level as the multiple is less than or equal to the preset multiple;

or, determining the clamping position state to be the clamping position reaching state, when the second digital signal is a low level as the multiple is greater than a preset multiple;

determining the clamping position state to be the clamping position non-reaching state, when the second digital signal is a high level as the multiple is less than or equal to the preset multiple;

if the clamping position state is determined by acquiring a difference value between the voltage value corresponding to the second voltage signal and the preset voltage value; then determining the clamping position state to be the clamping position reaching state, when the second digital signal is a high level as the difference value is greater than a preset difference value;

determining the clamping position state to be the clamping position non-reaching state, when the second digital signal is a low level as the difference value is less than or equal to the preset difference value;

or, determining the clamping position state to be the clamping position reaching state, when the second digital signal is a low level as the difference value is greater than a preset difference value;

determining the clamping position state to be the clamping position non-reaching state, when the second digital signal is a high level as the difference value is less than or equal to the preset difference value.

17. A computer readable storage medium, comprising: instructions which, when executed on a computer, cause the computer to execute the lock state monitoring method according to claim 8 to monitor the lock state of the lock assembly.

* * * * *